United States Patent [19]

Atkinson et al.

[11] 4,298,191

[45] Nov. 3, 1981

[54] MOBILE APPARATUS FOR CONTAINING MOLTEN METAL

[75] Inventors: Donald A. Atkinson; Colin F. McCulloch, both of Stockton-on-Tees, England

[73] Assignee: Davy McKee (Minerals & Metals) Limited, Stockton-on-Tees, England

[21] Appl. No.: 113,699

[22] Filed: Jan. 21, 1980

[30] Foreign Application Priority Data

Jan. 19, 1979 [GB] United Kingdom ..... 02031/79

[51] Int. Cl.[3] ..... C21B 3/10

[52] U.S. Cl. ..... 266/165

[58] Field of Search ..... 266/165; 75/46, 53

[56] References Cited

U.S. PATENT DOCUMENTS

| | | | |
|---|---|---|---|
| 3,013,789 | 12/1961 | Sayre | 75/46 |
| 3,039,627 | 6/1962 | Sayre | 266/165 |
| 3,944,195 | 3/1976 | Buell | 75/53 |

*Primary Examiner*—P. D. Rosenberg

*Attorney, Agent, or Firm*—Schwartz & Weinrieb

[57] ABSTRACT

Mobile apparatus for containing molten metal, known as a torpedo car, comprises an elongate vessel rotatably supported at its ends on a pair of bogie assemblies, flange members on the vessel extending around at least part of the opening and one or more lid assemblies arranged to fit over the opening and be removably secured to the flange members, the lid assembly or assemblies, when fitted, closing off less than the entire opening.

6 Claims, 4 Drawing Figures

MOBILE APPARATUS FOR CONTAINING MOLTEN METAL

FIELD OF THE INVENTION

This invention relates to mobile apparatus for containing molten metal, sometimes known as torpedo cars. These cars are used for transferring molten metal between stations in a steelworks and comprise an elongate vessel rotatably supported at its ends on a pair of bogie assemblies, one of which is provided with a drive to rotate the vessel about its longitudinal axis. The vessel is fabricated from steel plate and it is lined with refractory material. A pouring spout is provided through which the molten metal enters and leaves the vessel.

A disadvantage with this construction is that, when the vessel has been in use for some time and it is necessary to replace the refractory lining, access for personnel into the vessel is through the spout and all the old refractory material and the new refractory material has to be moved through the spout.

OBJECTS OF THE INVENTION

It is an object of the present invention to provide mobile apparatus for containing molten metal in which the relining operation can be carried out under much improved conditions.

SUMMARY OF THE INVENTION

According to a first aspect of the invention, mobile apparatus for containing molten metal comprises an elongate vessel rotatably supported at its ends on a pair of bogie assemblies, an opening formed in the wall of the vessel, flange members on the vessel extending around at least part of the opening and a lid assembly arranged to fit over the opening and be removably secured to the flange members, the lid assembly, when fitted, closing off less than the entire opening.

BACKGROUND OF THE INVENTION

The lid assembly may comprise two separate parts arranged to fit over respective parts of the opening and be removably secured to the flange members, the two parts of the assembly, when fitted, together closing off less than the entire opening.

With this construction, during normal use, the lid assembly is secured to the vessel and molten metal is transferred into and out of the vessel through the part of the opening which is not closed by the lid assembly. When it is necessary to replace the refractory lining, the lid assembly is detached from the flange members and removed thereby exposing the entire opening in the wall of the vessel. A large portion of the refractory brickwork is also exposed and this can very quickly be wrecked from outside exposing a large area of the interior of the vessel. The opening is of sufficient size to enable personnel and materials to readily enter into and leave the elongate vessel.

The removal of the refractory brickwork below the lid assembly permits rapid cooling of the refractory material and the brickwork can be removed speedily by the appropriate mechanical equipment, operating through the large opening in the wall of the vessel. The vessel remains attached to its bogie assemblies and it can be tilted to ease access into the vesel and rubble produced during the wrecking operation can be removed simply by rotating the vessel to allow the rubble to fall through the opening.

In order to replace the refractory material, the lower part of the vessel can be relined before the lid assembly is refitted. The remaining part of the relining takes place after the lid asembly has been fitted and a spout opening is formed in refractory material in the opening not covered by the lid assembly. Alternatively, the lid assembly can be replaced immediately when the old lining has been removed and the entire new lining provided subsequent to the re-positioning of the lid assembly.

If distortion of the lid assembly occurs during use of the torpedo car, a replacement assembly can be readily fitted to the car to return it to service as soon as possible and repairs to the original lid assembly can be carried out away from the torpedo car.

BRIEF DESCRIPTION OF THE DRAWINGS

In order that the invention may be more readily understood it will now be described, by way of example only, with reference to the accompanying drawings, in which.

DETAILED DESCRIPTION OF THE PREFERRED EMBODIMENT

Figure 1:
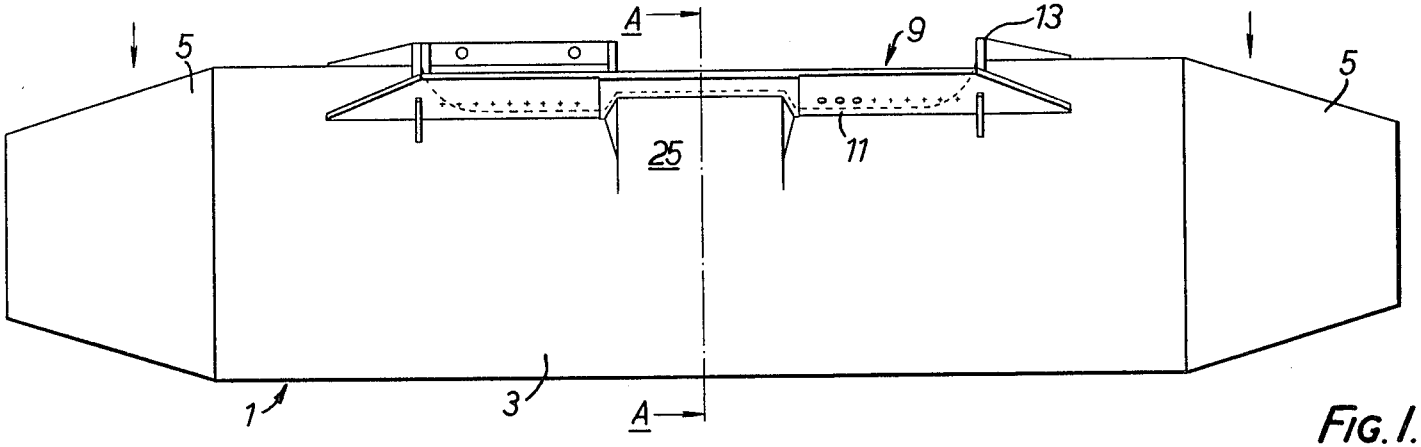
FIG. 1 is a side elevation of an elongate vessel forming part of a torpedo car.

A torpedo car for transporting molten metal comprises an elongate vessel 1 having a generally cylindrical centre portion 3 and bell-shaped end portions 5. Each end portion is trunnion mounted on a separate bogie assembly (not shown). Each bogie assembly has a number of wheels which enable the torpedo car to be moved along railway lines, one of which is indicated by reference numeral 7. The trunnion assembly on the bogie at one end of the car carries turning gear by which the vessel can be rotated about its longitudinal axis.

Figure 3:
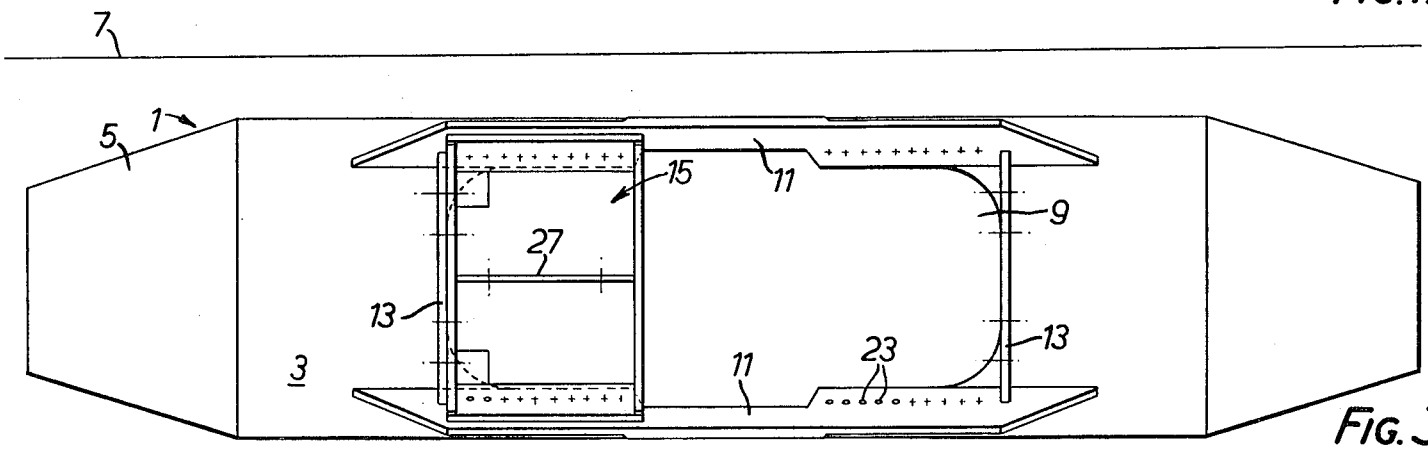
FIG. 3 is a plan view of the vessel shown in FIG. 1 with one part of the lid assembly mounted in position and the other omitted.
Figure 2:
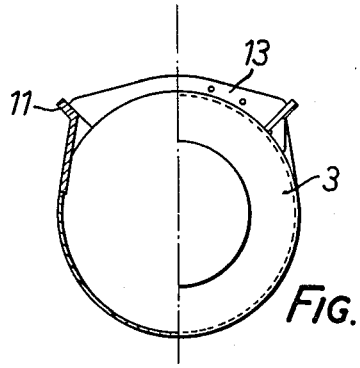
FIG. 2 is a half section on the line A—A of FIG. 1.
Figure 4:
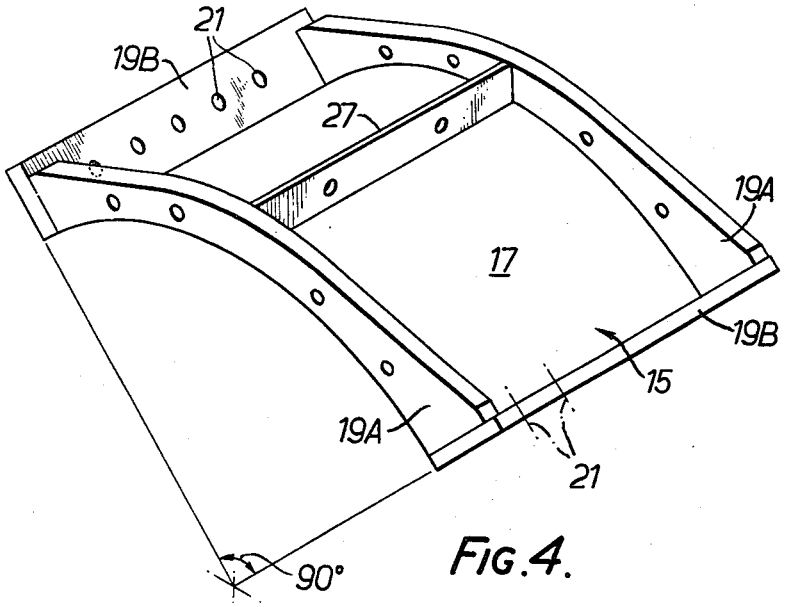
FIG. 4 is a perspective view of one part of the lid assembly.

The vessel is manufactured from steel plates and contains a lining of refractory material. As can be more readily seen from FIG. 3, a large opening 9 is formed in the wall of the centre position 3 of the vessel. This opening is of generally rectangular plan and the longer sides of the opening extend parallel to the longitudinal axis of the vessel. The opening extends around approximately one quarter of the periphery of the centre part of the vessel and consequently the longer sides of the opening subtend an angle of approximately 90° at the centre of the vessel. Adjacent to each of the longer sides of the opening, extending parallel to the longitudinal axis of the vessel, there are a pair of elongate flange members 11, one on each side of the opening. These flange members are rigidly secured to the walls of the vessel. At each end of the opening 9 a further flange member 13 is provided, the flange members being rigidly secured to the vessel. The vessel is provided with a lid assembly comprising two parts 15, one of which is shown in FIG. 4. These parts of the lid assembly are arranged to fit over respective end portions of the opening and, when so fitted, to close off less than the entire opening, so that a part of the opening is exposed between the two parts of the lid assembly.

Each part of the lid assembly comprises a curved metal plate 17 of rectangular plan and having pairs of upstanding flanges 19A, 19B extending along opposite sides of the plate. When each assembly part is positioned over an end portion of the opening 9, the flanges 19B abut against the flanges 11 provided on the vessel and a number of openings 21 are provided in the flanges 19B and similarly openings 23 are provided in the flanges 11, whereby the assembly can be removably secured to the flange members 11 by means of cottered bolts (not shown). At the same time, one of the flanges 19A abuts against the corresponding flange member 13 on the vessel and openings in the two flange members enables cottered bolts to be used to secure them together.

When the two parts of the lid assembly are mounted in position on the vessel, there is a space between them through which molten metal enters and leaves the vessel. The refractory material inside the vessel is built up into the space between the two parts of the lid assembly to provide a spout through which the molten metal enters and leaves. To protect the flanges 19A which are adjacent to the opening, cast iron shoes can be replaceably fitted over the flange members so that, should they become damaged, the cast iron shoes can readily be replaced. The sides of the vessel which define the opening remaining when the two parts of the lid assembly are fitted may also be provided with cast iron protection shoes and in addition a refractory splash plate 25 is fitted on each side to protect the wall of the vessel from the molten metal.

A plate 27 is secured to each part of the lid assembly and serves to allow the lid part to be lifted away from the vessel by an overhead crane. After each part has been positioned on the vessel, it may be covered with a layer of refractory material which protects it from molten metal. Preferably, the two parts of the lid assembly are identical so that, when one part becomes damaged or distorted due to the effect of molten metal, it can be readily replaced by a stock item.

In the embodiment shown, the two parts of the lid assembly are removed separately from the vessel after the cottered bolts have been removed. It is envisaged that, although the two parts are separate, they could be connected together by longitudinally extending members to constitute a single lid assembly and thereby enable the entire assembly to be lifted from the vessel by means of an overhead crane.

Obviously, many modifications and variations are possible in light of the above teachings. It is therefore to be understood that within the scope of the appended claims, the present invention may be practiced otherwise than as specifically described herein.

We claim:

1. Mobile apparatus for transporting molten metal, comprising:

an elongate vessel rotatably supported at its ends on a pair of bogie assemblies;

opening means defined within a wall portion of said vessel for permitting personnel access to the interior of said vessel;

flange means fixedly secured upon said vessel within the vicinity of said opening; and lid means removably secured to said flange means for partially covering said opening means and thereby defining a spout means for loading and discharging of said molten metal into and out of said vessel when said lid means is disposed upon said vessel, yet permitting access to said interior of said vessel by said personnel through said opening means when said lid means is removed from said vessel.

2. Mobile apparatus as set forth in claim 1, wherein: said lid means comprises a pair of removable lid assemblies.

3. Mobile apparatus as claimed in claim 2, in which said lid assemblies are identical and are arranged to fit over respective end parts of the opening.

4. Mobile apparatus as claimed in claim 1, 2 or 3, in which said opening is of generally rectangular plan with the longer sides thereof extending parallel to the longitudinal axis of the vessel.

5. Mobile apparatus as claimed in claim 4, in which at least the centre part of the vessel is of substantially circular cross section and the opening has an angular extent, as defined about the periphery of the centre part of the vessel and relative to said longitudinal axis of said vessel, which subtends an angle of approximately 90°.

6. Mobile apparatus as claimed in claim 1 or 2, in which the vessel is lined with a refractory material and said material extends into the space remaining in the opening when the or each lid assembly is fitted to the vessel to define a spout through which molten metal enters and leaves the vessel.

* * * * *